US007353791B2

(12) United States Patent
Sasaki et al.

(10) Patent No.: US 7,353,791 B2
(45) Date of Patent: Apr. 8, 2008

(54) SOUND INCREASE APPARATUS

(75) Inventors: Akira Sasaki, Kanagawa (JP); Hiroyuki Abe, Kawasaki (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 11/528,244

(22) Filed: Sep. 28, 2006

(65) Prior Publication Data

US 2007/0079784 A1 Apr. 12, 2007

(30) Foreign Application Priority Data

Oct. 7, 2005 (JP) ..... 2005-295410
Dec. 28, 2005 (JP) ..... 2005-377844

(51) Int. Cl.
*F02M 35/12* (2006.01)

(52) U.S. Cl. ..... 123/184.57; 123/184.53; 123/184.56

(58) Field of Classification Search ..... 123/184.53, 123/184.55, 184.56, 184.57, 184.21
See application file for complete search history.

(56) References Cited

U.S. PATENT DOCUMENTS 5,107,800 A * 4/1992 Araki et al. ..... 123/184.57
5,333,576 A * 8/1994 Verkleeren ..... 123/184.53
5,823,157 A * 10/1998 Muramatsu ..... 123/184.56
5,957,102 A * 9/1999 Schorn ..... 123/184.57
6,105,546 A * 8/2000 Fuesser et al. ..... 123/184.57
6,422,192 B1 * 7/2002 Bloomer ..... 123/184.57
6,494,290 B1 * 12/2002 Jessberger ..... 181/250
6,508,331 B1 * 1/2003 Stuart ..... 181/250
6,539,917 B2 * 4/2003 Shaw et al. ..... 123/339.1
6,609,489 B1 * 8/2003 Slopsema et al. ..... 123/184.57
6,684,841 B2 * 2/2004 Ekstrom ..... 123/184.21
6,814,041 B1 * 11/2004 Cheng et al. ..... 123/184.57
7,055,484 B2 * 6/2006 Marks et al. ..... 123/184.57
7,077,093 B2 * 7/2006 Koelmel et al. ..... 123/184.57
7,089,901 B2 * 8/2006 Kino et al. ..... 123/184.57
2006/0283658 A1 * 12/2006 Abe et al. ..... 181/204
2007/0131189 A1 * 6/2007 Shinada et al. ..... 123/184.57

FOREIGN PATENT DOCUMENTS

JP 2003-97371 * 4/2003
JP 2004-218458 A 8/2004
JP 2005-139982 * 6/2005
JP 2006-291752 * 10/2006

* cited by examiner

*Primary Examiner*—Hai Huynh
(74) *Attorney, Agent, or Firm*—Foley & Lardner LLP

(57) ABSTRACT

A sound increase apparatus includes a first hollow body member that communicates with an intake flow path of an internal combustion engine, a second hollow body member that communicates with the first hollow body member, and a vibration member capable of vibrating in an out-of-plane direction, which is inserted in a connection between the first and second hollow body members and closes a cross section of the connection. The second hollow body member has a plurality of opening portions, each of which communicates with the air.

23 Claims, 7 Drawing Sheets

ENGINE RPM: LOW

ENGINE RPM: MIDRANGE

ENGINE RPM: HIGH

SOUND INCREASE APPARATUS

BACKGROUND OF THE INVENTION

The present invention relates to a sound increase apparatus which is capable of improving sound quality of an intake sound that is generated from an inlet system of internal combustion engine, and capable of increasing the intake sound over wide range of frequencies.

In recent years, there have been proposed and developed various sound increase apparatus capable of improvement of sound quality and increase of the intake sound generated from the inlet system of internal combustion engine. One such sound increase apparatus has been disclosed in Japanese Patent Provisional Publication No. 2004-218458 (hereinafter is referred to as "JP2004-218458"). In JP2004-218458, an opening is formed on a side wall of an air induction part that forms an intake flow path, and the opening and a dash panel are connected by flexible tubes. Then, the intake sound having pressure oscillations resonates with the dash panel, and the intake sound is conveyed into a vehicle cabin. And thus, a sporty intake sound can be rendered in the cabin.

SUMMARY OF THE INVENTION

In the above sound increase apparatus in JP2004-218458, however, since the air induction part communicates with the cabin via the flexible tubes, the air is taken in from about the cabin too on the intake stroke of the engine. In addition, the flexible tube connecting the air induction part and the dash panel is considerably long, so that there is a problem that a range of frequency (timbre) of the intake sound, in which the intake sound can be increased, are limited to a narrow range. And it is therefore difficult to adequately convey the intake sound over a variety of frequency ranges.

It is an object of the present invention to provide a sound increase apparatus which is capable of conveying the intake sound over wide range of frequencies without taking the air in from about the cabin and rendering a pleasant sound.

According to one aspect of the present invention, a sound increase apparatus comprises a first hollow body member that communicates with an intake flow path of an internal combustion engine; a second hollow body member that communicates with the first hollow body member; and a vibration member capable of vibrating in an out-of-plane direction, which is inserted in a connection between the first and second hollow body members and closes a cross section of the connection, and the second hollow body member has a plurality of opening portions, each of which communicates with the air.

The other objects and features of this invention will become understood from the following description with reference to the accompanying drawings.

DETAILED DESCRIPTION OF THE INVENTION

Figure 1:
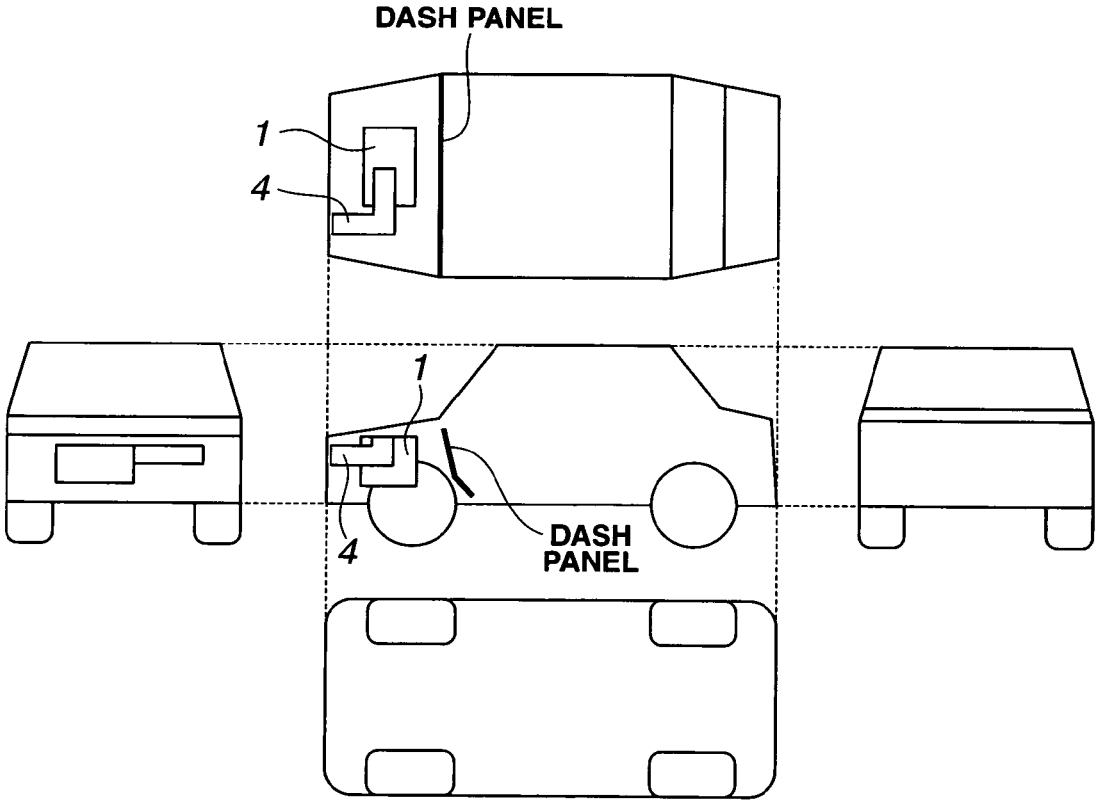
FIG. 1 is a diagram that explains a layout of a sound increase apparatus of embodiment.
Figure 8:
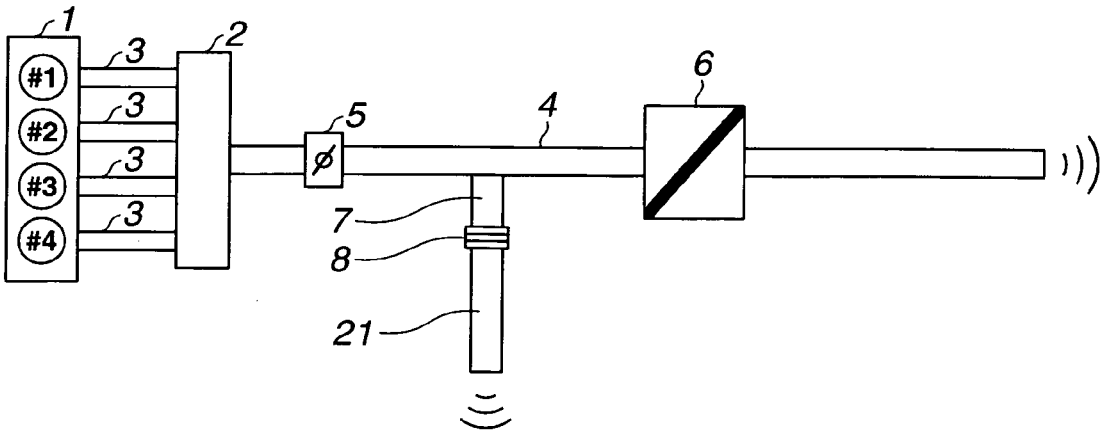
FIG. 8 is a diagram that explains a configuration of a hypothetical sound increase apparatus.

Embodiments of the present invention will be explained below with reference to the drawings. FIG. 1 shows a layout of a sound increase apparatus according to the embodiments, which is applied to a front engine vehicle. Before explaining a first embodiment, in order to prevent the air in the cabin from being taken in, a sound increase apparatus having a configuration as shown in FIG. 8 could be provided. That is, the configuration is as follows. One opening end of a first hollow pipe 7 (corresponding to a first hollow body member) is connected to an intake flow path 4 at some midpoint of the intake flow path 4. Then first hollow pipe 7 communicates with an intake flow path 4. And a second hollow pipe 21 (corresponding to a second hollow body member) is connected to the other opening end of first hollow pipe 7 through a diaphragm 8 (corresponding to a diaphragm member). In the hypothetical sound increase apparatus having this configuration, it is possible to prevent the air in the cabin from being taken in by inserting the diaphragm between the first and second hollow pipes. As a result, the sound increase apparatus can be attached to an arbitrary position of the intake flow path. Further, it is possible to amplify pressures of sounds at around two resonance frequencies which are formed by the first and second hollow body members from among sounds residing inside the intake flow path, and to convey and emit the sounds. However, it may be difficult to increase the sound having middle frequencies between the above two resonance frequencies with this configuration. On the other hand, in the following embodiments, besides preventing the air in the cabin from being taken in, it can be possible to increase the sound over wide range of frequencies by providing a plurality of opening ends at the second hollow body member, namely that by using the second hollow body member having the plurality of opening ends that open at different positions from each other.

Figure 2:
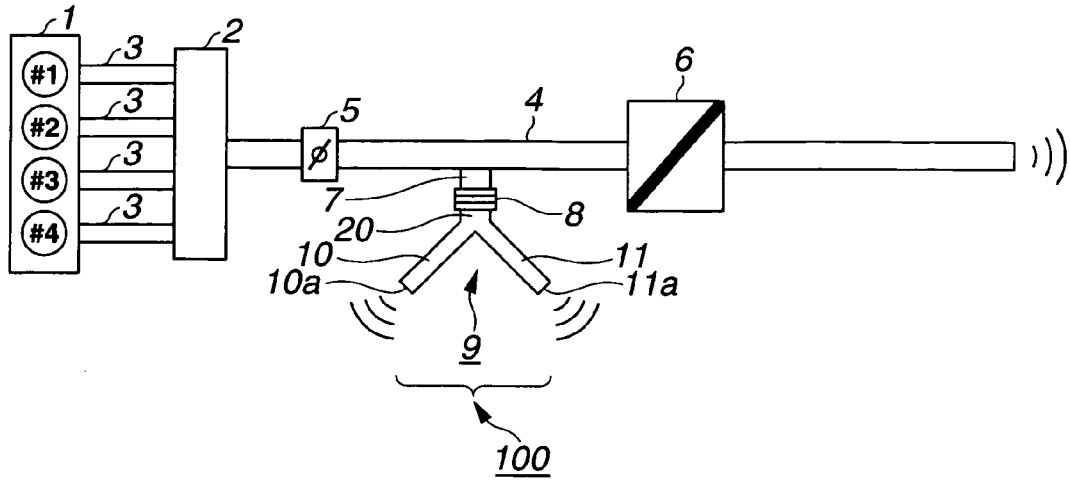
FIG. 2 is a diagram that explains a configuration of a sound increase apparatus and an inlet system of internal combustion engine according to a first embodiment of the present invention.

Firstly, a first embodiment will be explained below. FIG. 2 shows a configuration of a sound increase apparatus 100 and an inlet system of internal combustion engine. One end of an engine intake duct 4 that forms the intake flow path is opened to the air. And the other end of engine intake duct 4 communicates with each cylinder of an engine 1 through a surge tank 2 and each intake manifold 3. At some midpoint of engine intake duct 4, an air cleaner 6 and a throttle chamber 5 are interposed between one and the other ends of engine intake duct 4.

Here, throttle chamber 5 performs the function of increasing/decreasing the quantity of an incoming air into surge tank 2 according to the depression amount of accelerator pedal. Engine 1 is a source of vibration which generates intake pulsations in the air residing inside engine intake duct 4 with or in response to intake actions of engine 1, and then the intake pulsations become a sound source of an intake sound. These intake pulsations are pressure fluctuations or pressure oscillations which are generated in the air residing inside engine intake duct 4, and the pressure fluctuations have a plurality of fluctuation frequencies or a plurality of frequency component.

In the embodiment, sound increase apparatus 100 is connected to engine intake duct 4 between throttle chamber 5 and air cleaner 6. In more detail, sound increase apparatus 100 has a hollow pipe or tube 7 (or an intake flow path communicating pipe 7) whose one opening end portion is connected to engine intake duct 4, a diaphragm 8 that closes the other opening end portion of hollow pipe 7, and a second hollow body member 9 that is connected to hollow pipe 7 through diaphragm 8. Here, the above hollow pipe 7 is a first hollow body member.

Diaphragm 8 is a vibration or oscillation member, and is formed from elastic membrane or film etc. And diaphragm 8 vibrates or oscillates in an out-of-plane direction by or in response to inside-pressure fluctuations. As for second hollow body member 9, it has a communicating portion 20 (or a connecting pipe, or hollow pipe 20) that is a pipe connecting to hollow pipe 7 through diaphragm 8, and two branch pipes 10, 11 (or first and second outside communicating pipe 10, 11) that branch off at the other end portion of communicating portion 20. Each top end opening portions 10*a*, 11*a* of branch pipes 10, 11 is opened, and each of them forms an opening portion of second hollow body member 9. Two branch pipes 10, 11 are arranged in different extending directions from each other, but they are communicated with each other via communicating portion 20. In this embodiment, although top end opening portions 10*a*, 11*a* of branch pipes 10, 11 are placed in an engine room, directions and positions of top end opening portions 10*a*, 11*a* are different from each other.

Next, the workings and the effects of the above configuration of the sound increase apparatus will be explained. Intake pulsations generated by the source of vibration (namely, engine 1) propagate into engine intake duct 4 through intake manifold 3 and surge tank 2. The intake pulsations vibrate diaphragm 8 through hollow pipe 7, and thereby conveying the intake pulsations to downstream or lower second hollow body member 9 while preventing the air in the cabin from being taken in. When the intake pulsations are conveyed, an intake pulsation having a first resonance frequency that is formed by hollow pipe 7 and diaphragm 8 and an intake pulsation having a second resonance frequency that is formed by second hollow body member 9 and diaphragm 8 are amplified or intensified. And then, these intake pulsations are emitted or radiated from top end opening portions 10*a*, 11*a* of branch pipes 10, 11. At this time, each top end opening portions 10*a*, 11*a* of branch pipes 10, 11 is opened at different positions in the engine room, so that two acoustic or sound transfer characteristics from opening position to the cabin are different from each other. Because of this, each sound (intake pulsation) emitted from respective top end opening portions 10*a*, 11*a* is propagated into the cabin under the influence of the different sound transfer characteristics.

For instance, in the following case; one top end opening portion 10*a* of branch pipe 10 is placed at a position where the sounds of the two resonance frequencies or of the frequencies respectively close to the two resonance frequencies are more easily conveyed into the cabin, whereas the other top end opening portion 11*a* of branch pipe 11 is placed at a position where the sounds of the two resonance frequencies are not easily conveyed into the cabin but the sounds of middle frequencies between the two resonance frequencies are more easily conveyed into the cabin, pulsation sounds strengthened or intensified at around two resonance frequencies by the sound increase apparatus are efficiently propagated from top end opening portion 10*a* to the cabin, meanwhile, pulsation sounds of band of frequencies where resonance action is unavailable are emitted from top end opening portion 11*a*. Consequently, pulsation sounds of the two resonance frequencies and the middle frequency band between the two resonance frequencies are propagated into the cabin more efficiently than the other frequency band. An increase effect of intake pulsation sounds can be therefore obtained over wide range of frequencies.

As explained above, by the configuration of the sound increase apparatus, even if hollow pipe 7 and second hollow body member 9 are formed small, the increase of intake pulsation sounds not only of the two resonance frequencies but also of the middle frequency band between the two resonance frequencies can be achieved by adjustment of positions etc of top end opening portions 10*a*, 11*a*. Therefore, frequency band where the increase of sound is available does not become narrow, in other words, a sporty intake sound can be rendered in the cabin over wide range of frequencies, while preventing the air in the cabin from being taken in.

Here, in the above configuration, top end opening portions 10*a*, 11*a* of branch pipes 10, 11 are opened in the engine room. However, it is not limited to this. For example, it may be possible that either one or both of top end opening portions 10*a*, 11*a* opens at an air box (in a cowl top) positioned at an upper portion of dash panel or at the inside of a fender, and so on. In those cases, it can be possible to further efficiently propagate the intake pulsation sounds into the cabin.

Further, in the above embodiment, the number of the branch pipe that branches off is two. However, it can also be three or more branch pipes. In that case as well, a plurality of branch pipes are placed so that each position of the top end opening portions of the branch pipes is different from each other. Furthermore, The first hollow body member is formed by hollow pipe 7. However, it is not to limited to tubular-shaped hollow body member. For example, it may be ball-shaped hollow body member etc that have two opening portions. That is, the shape of the first hollow body member is not limited as long as the first hollow body member is formed by a closed space (hollow space) that has two opening portions; one is connected to engine intake duct 4, the other is connected to second hollow body member 9. With respect to second hollow body member 9, it is not limited to the tubular-shaped hollow body member, either. And this second hollow body member 9 connecting to the first hollow body member may be two or more.

Moreover, in the embodiment, the sound increase apparatus is provided at the side of engine 1 (namely, that the connecting position of the sound increase apparatus is between engine 1 and air cleaner 6). However, the sound increase apparatus may be provided between air cleaner 6 and the one end of engine intake duct 4. But, it is preferable that the connecting position is near to engine 1 which is the vibration source. In addition, for the sake of target sound or tone quality, a third opening portion (other opening portion) may be properly provided at some midpoint in an axial direction of the branch pipe.

Figure 3:
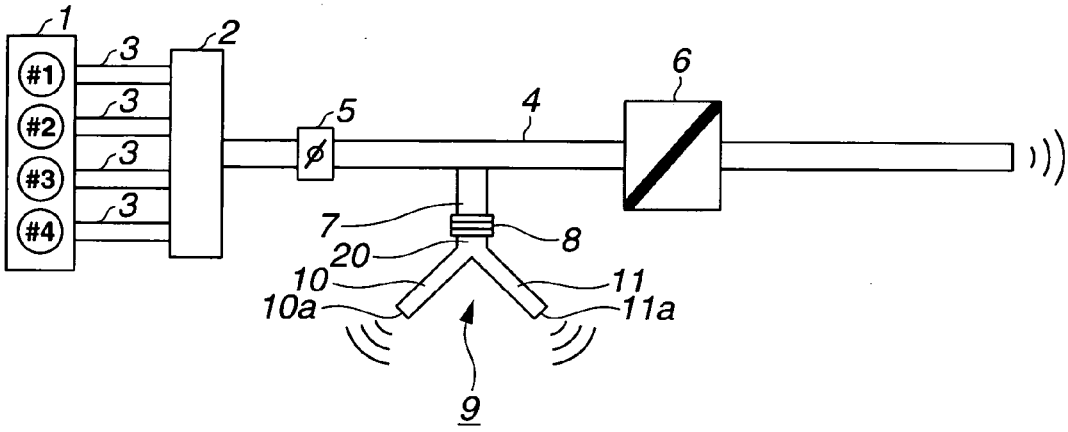
FIG. 3 is a diagram that explains a configuration of a sound increase apparatus and the inlet system according to a second embodiment.

Next, modified examples (from second embodiment to sixth embodiment) will be explained below. Firstly, a second embodiment will be explained. FIG. 3 shows a configuration of the second embodiment. In FIG. 3, the same parts as that of the first embodiment are denoted by the same reference letters. The configuration of the second embodiment is basically the same as that of the first embodiment except for a length of hollow pipe 7. In the second embodiment, the length of hollow pipe 7 is set to be longer than that of the first embodiment. For instance, it is set to an average length of two branch pipes 10, 11, or set to be close to the average length. In this configuration, by setting the length of hollow pipe 7 to the average length of two branch pipes 10, 11 or to be close to the average length, the resonance frequency of hollow pipe 7 (the resonance frequency formed by hollow pipe 7) can be much closer to the resonance frequency of second hollow body member 9. As a result, it is possible to increase or strengthen intake pulsation sounds around the resonance frequency more.

Figure 4:
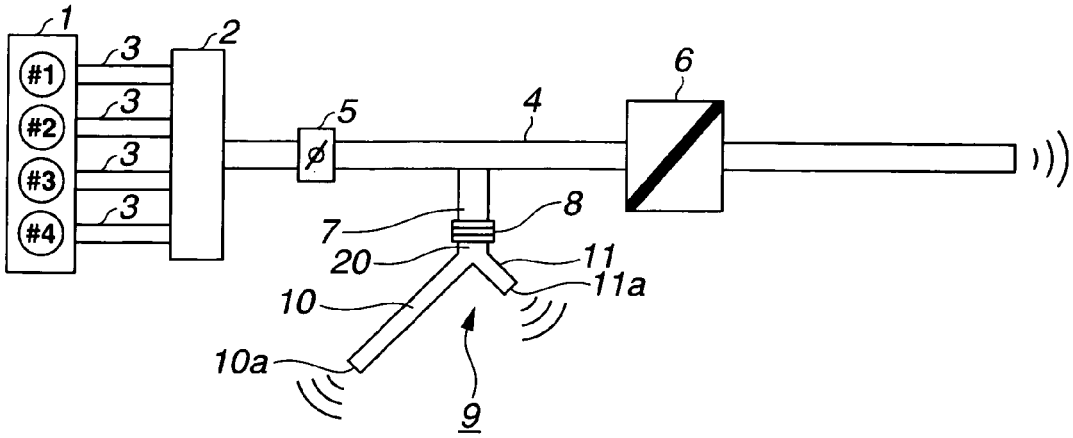
FIG. 4 is a diagram that explains a configuration of a sound increase apparatus and the inlet system according to a third embodiment.

A third embodiment will be explained below. FIG. 4 shows a configuration of the third embodiment. In FIG. 4, the same parts as those of the above embodiments are denoted by the same reference letters. The configuration of the third embodiment is basically the same as that of the second embodiment except for two lengths of branch pipes 10, 11. In the third embodiment, the two lengths of branch pipes 10, 11 are set to be different from each other. In this configuration, by setting the two lengths of branch pipes 10, 11 to be different form each other, flexibility in setting the top end opening portions to positions where a desired sound transfer characteristic is obtained can be increased.

Figure 5:
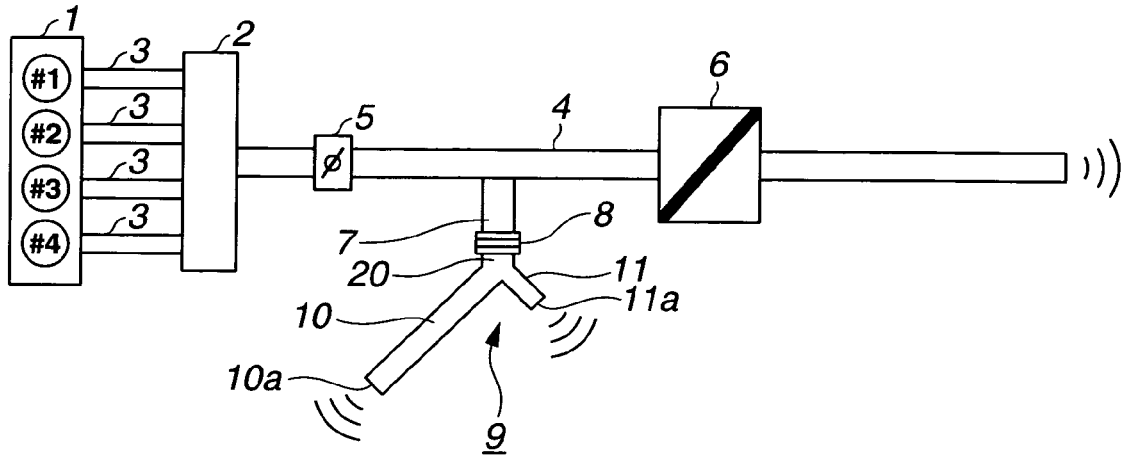
FIG. 5 is a diagram that explains a configuration of a sound increase apparatus and the inlet system according to a fourth embodiment.

A fourth embodiment will be explained below. FIG. 5 shows a configuration of the fourth embodiment. In FIG. 5, the same parts as those of the above embodiments are denoted by the same reference letters. The configuration of the fourth embodiment is basically the same as that of the second embodiment except for two cross-sectional areas of branch pipes 10, 11. In the fourth embodiment, the two cross-sectional areas of branch pipes 10, 11 are set to be different from each other. By setting the two cross-sectional areas of branch pipes 10, 11 to be different from each other, it can be possible to set the top end opening portions to arbitrary positions so as to obtain the desired sound transfer characteristic, and further to adjust an increased sound level of the intake pulsation sound to suit each sound transfer characteristic.

Figure 6:
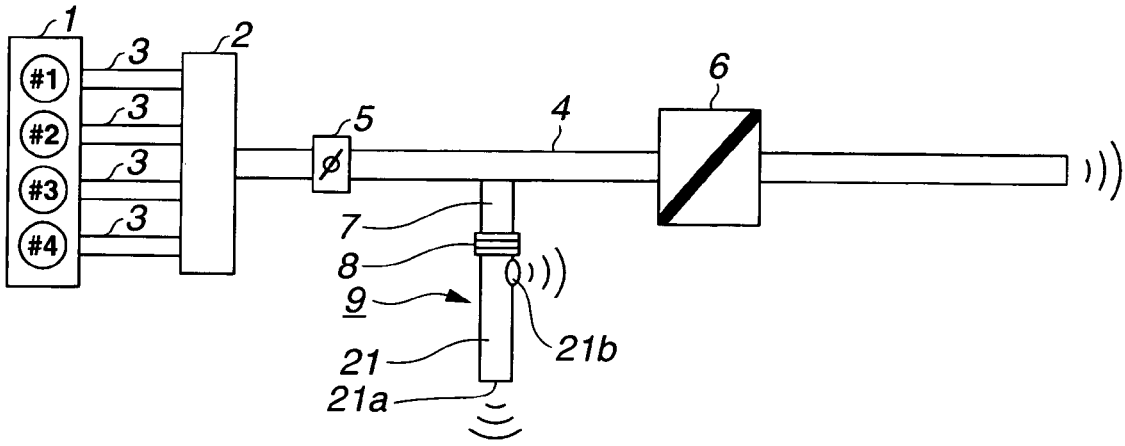
FIG. 6 is a diagram that explains a configuration of a sound increase apparatus and the inlet system according to a fifth embodiment.

A fifth embodiment will be explained below. FIG. 6 shows a configuration of the fifth embodiment. In FIG. 6, the same parts as those of the above embodiments are denoted by the same reference letters. The configuration of the fifth embodiment is basically the same as that of the second embodiment except for a configuration of second hollow body member 9. That is, second hollow body member 9 is formed by a piece of a pipe or tube 21 (or a hollow pipe 21). At one end of pipe 21, an opening 21*a* is formed as a first opening portion. And an opening 21*b* is formed at some midpoint in an axial direction of pipe 21 as a second opening portion. In this configuration, since second hollow body member 9 is formed by only a piece of pipe 21, the increase effect of intake pulsation sounds can be achieved with low cost. In addition to this, flexibility in the layout of the sound increase apparatus can be increased.

Figure 7:
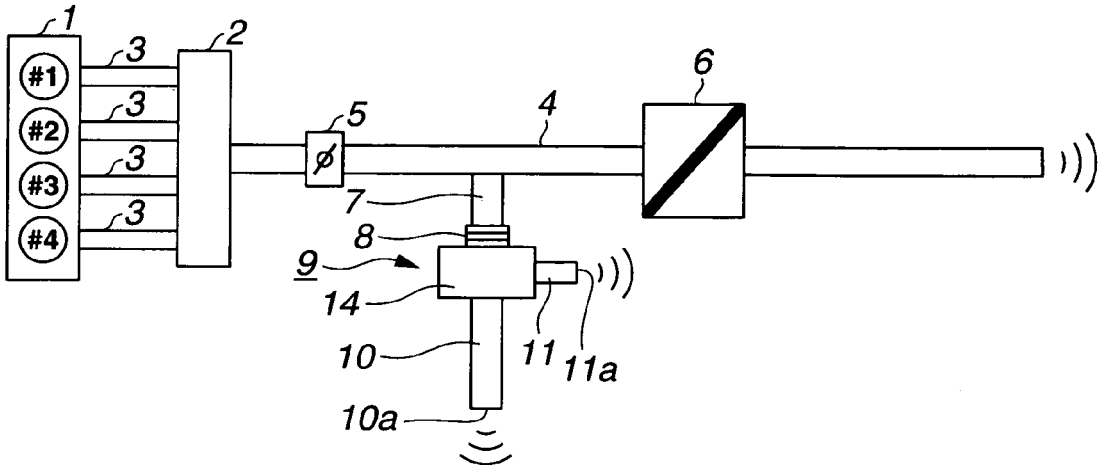
FIG. 7 is a diagram that explains a configuration of a sound increase apparatus and the inlet system according to a sixth embodiment.

A sixth embodiment will be explained below. FIG. 7 shows a configuration of the sixth embodiment. In FIG. 7, the same parts as those of the above embodiments are denoted by the same reference letters. The configuration of the sixth embodiment is basically the same as that of the second embodiment except for a configuration of second hollow body member 9. In this embodiment, second hollow body member 9 is formed of two branch pipes 10, 11 and a voluminous hollow portion 14 whose cross-sectional area is larger than that of hollow pipe 7, also larger than the sum of cross-sectional areas of the each branch pipe. That is, hollow portion 14 connects to the other opening end portion of hollow pipe 7 through diaphragm 8, and two branch pipes 10, 11 are connected to hollow portion 14. Regarding connecting directions of branch pipes 10, 11, in FIG. 7, the first branch pipe 10 is coaxially aligned with hollow pipe 7. As for the second branch pipe 11, it is connected to hollow portion 14 in a direction orthogonal to the axis of hollow pipe 7. By the configuration of the sixth embodiment, in a case where a desired resonance frequency is the same resonance frequency as the second embodiment, the length of the second branch pipe 11 can be set to be shorter than that of the second embodiment through the existence of voluminous hollow portion 14. The increase effect of intake pulsation sounds can be therefore obtained with a more compact configuration. Here, in order to control or adjust the sound quality or to obtain a desired sound quality, the sound increase apparatus in the above mentioned embodiments can be properly combined with each other.

Figure 9:
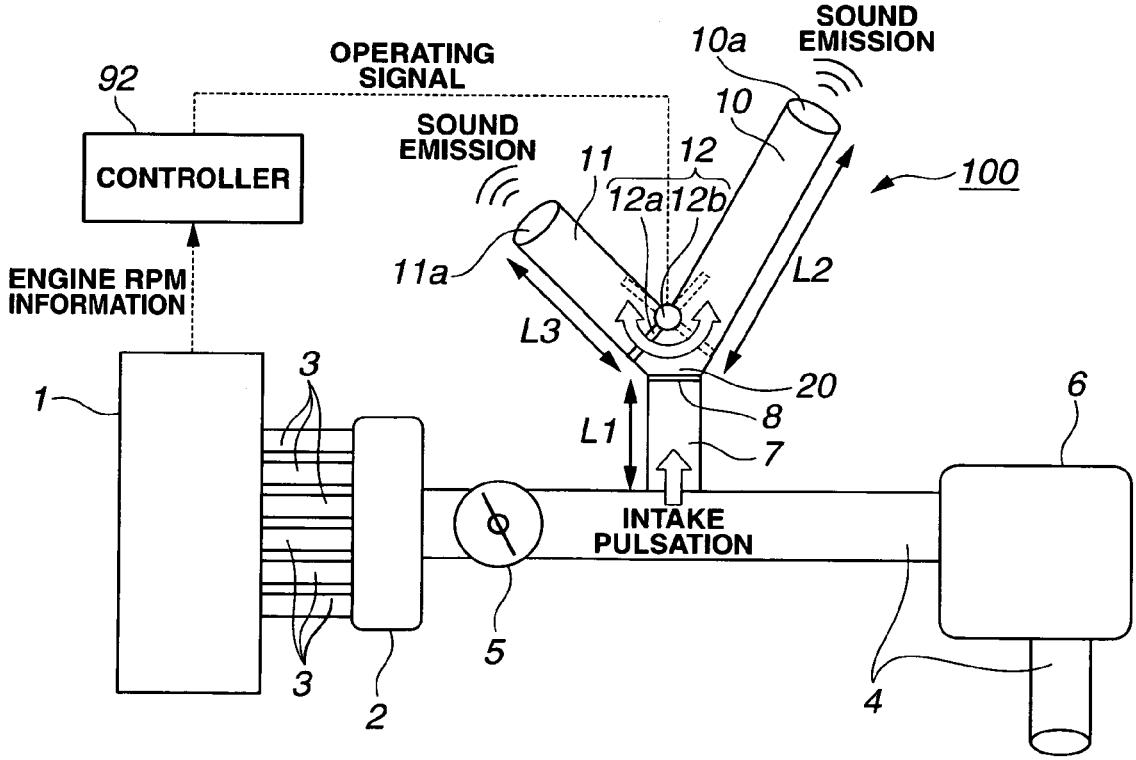
FIG. 9 is a diagram that explains a configuration of a sound increase apparatus and the inlet system according to a seventh embodiment.

Next, embodiments other than the above modified examples will be explained. In FIG. 9, a configuration of a seventh embodiment is shown. In this embodiment, the sound increase apparatus 100 further has a valve 12 inside communicating portion 20, and a controller 92. With respect to branch pipes 10, 11, the length of branch pipe 10 is longer than that of branch pipe 11. That is, two lengths of branch pipes 10, 11 and also their two extending directions are different from each other, like the third embodiment. However, these can be set in accordance with frequencies of desired intake sounds or a space of the engine room.

As for valve 12 and controller 92, in more detail, valve 12 is formed of an open/close member 12*a* and an actuator 12*b*, and is provided inside communicating portion 20. Open/close member 12*a* is a member whose size can substantially cover each cross section or surface of section of branch pipes 10, 11 in communicating portion 20, and is driven by actuator 12*b*. Actuator 12*b* receives operating or driving signals from after-mentioned controller 92, then drives open/close member 12*a*, and thereby opens or closes the cross section of branch pipes 10, 11. In this embodiment, a stepping motor (not shown) is provided as actuator 12*b*, and open/close member 12*a* is attached to a driving shaft of the stepping motor.

Controller 92 determines which branch pipe is communicated with hollow pipe 7 (or which communicating pipeline is set) on the basis of engine rpm information that is detected by an engine rpm detection sensor (not shown). Then, controller 92 outputs the operating signals to actuator 12*b* based on the determination. In the shown embodiment, as the communicating pipeline, the following communicating pipelines can be set; a communicating pipeline where branch pipe 10 communicates with communicating portion 20, a communicating pipeline where branch pipe 11 communicates with communicating portion 20, and a communicating pipeline where branch pipe 10 and branch pipe 11 and communicating portion 20 are communicated with each other. And, for the above determination, a table storing a relationship between a threshold level or value of engine rpm and the communicating pipeline is provided, and controller 92 determines the setting of the communicating pipeline by using the table of the relationship. This controller 92 has CPU, RAM, and motor driver for actuator 12*b*, etc. besides ROM in which programs for the performance of the above function are stored. More specifically, controller 92 is built in electronic engine control unit (ECU) as a part of the function, and the engine rpm is detected at every predetermined time (for instance, every 10 msec) by a timer interrupt. Then, the operating signals for valve 12 are output in response to the change of engine rpm.

Figure 10A:
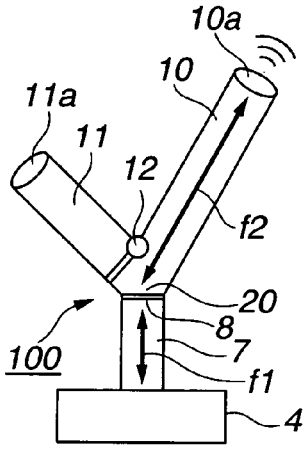
FIG. 10 is a diagram showing a state of the sound increase apparatus at various engine rpm.
Figure 10B:
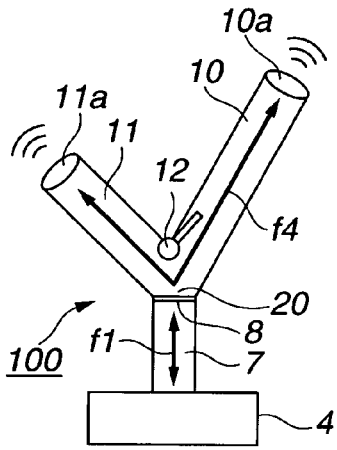
Figure 10C:
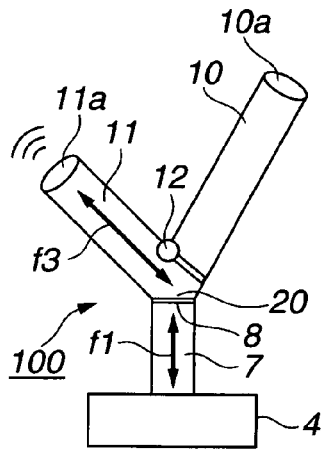

Next, the workings and the effects of the above configuration of the sound increase apparatus 100 will be explained. As shown in FIG. 10, in a case of low engine rpm (FIG. 10A), valve 12 opens branch pipe 10 and closes branch pipe 11. By this valve motion, the communicating pipeline where branch pipe 10 communicates with communicating portion 20 is formed. Under this condition, the intake pulsations generated by the source of vibration (namely, engine 1) propagate into engine intake duct 4 through intake manifold 3 and surge tank 2. When the intake pulsations propagate into hollow pipe 7, columns of air vibrate or oscillate, then the intake sounds around resonance frequency f1 fixed by the length L1 of the air column are amplified or intensified (or the intake sounds having resonance frequency f1 fixed by the length L1 of the air column or having frequencies close to the resonance frequency f1 are amplified or intensified).

Further, the intake pulsations propagated to hollow pipe 7 vibrates or oscillates diaphragm 8. Thus, the intake pulsations is conveyed to the downstream or lower communicating pipeline too through diaphragm 8. At this time, branch pipe 11 is closed with valve 12 as mentioned above. Because of this, the intake pulsations is not conveyed into branch pipe 11. And, air columns vibrate inside the communicating pipeline, then the intake sounds around resonance frequency f2 fixed by the length L2 of the air column are amplified or intensified. The amplified intake sounds are emitted or radiated from top end opening portion 10*a* of branch pipe 10, and further are propagated to the cabin. As described above, in the case where the engine rpm is low, the intake sounds around each resonance frequencies f1 and f2 are intensified. Here, when the intake pulsations are propagated to the communicating pipeline, the intake of air itself is prevented by diaphragm 8 and thus the air does not flow into the communicating pipeline.

Next, in a case of mid-range rpm (FIG. 10B), valve 12 opens both of the branch pipes 10, 11. By this valve motion, the communicating pipeline where branch pipes 10, 11 are communicated with each other through communicating portion 20 is formed. That is, two top end opening portions of the communicating pipeline open. Under this condition, at upstream side of diaphragm 8, the intake pulsations are propagated in the same way as the case of low engine rpm, and the intake sounds around resonance frequency f1 is amplified by hollow pipe 7. At downstream side of diaphragm 8, when the intake pulsations are propagated, air columns vibrate inside the above communicating pipeline where two top end opening portions open, then the intake sounds around resonance frequency f4 fixed by the length (L2+L3) of the air column are amplified or intensified. Here, L3 is the length of air column that is formed between branch pipe 11 and diaphragm 8 (see FIG. 9). As described above, in the case of mid-range rpm, the intake sounds around each resonance frequencies f1 and f4 are intensified.

Next, in a case of high engine rpm (FIG. 10C), valve 12 closes branch pipe 10 and opens branch pipe 11. By this valve motion, the communicating pipeline where branch pipe 11 communicates with communicating portion 20 is formed. Under this condition, at upstream side of diaphragm 8, the intake pulsations are propagated in the same way as the above cases, and the intake sounds around resonance frequency f1 is amplified by hollow pipe 7. At downstream side of diaphragm 8, the intake pulsations are propagated to the air columns residing inside the communicating pipeline, then the intake sounds around resonance frequency f3 fixed by the length L3 of the air column are amplified or intensified. As described above, in the case where the engine rpm is high, the intake sounds around each resonance frequencies f1 and f3 are intensified.

Here, the above resonance frequencies f1 to f4 are represented by the below expressions (1) to (4).

$$f1=(1/4)\cdot(c/L1) \quad (1)$$

$$f2=(1/4)\cdot(c/L2) \quad (2)$$

$$f3=(1/4)\cdot(c/L3) \quad (3)$$

$$f4=(1/2)\cdot\{(c/(L2+L3)\} \quad (4)$$

Here, c is the velocity of sound, c=331.4+0.604 t (t=Celsius degree). In the above expressions (4), the reason why (1/2) of f4 differs from the others is because the two top end opening portions of the communicating pipeline are opened.

In the shown embodiment, the lengths of hollow pipe 7 and branch pipes 10, 11 are set so that the resonance frequencies defined by the above expressions (1) to (4) are f1<f2<f4<f3. Accordingly, although as the engine rpm increases, the frequencies of intake sounds become higher, the sound increase apparatus 100 can amplify or strengthen the intake sounds of this high frequencies too in response to change of the frequency. Then, the intake sounds can be amplified over wide range of frequencies, and they can be propagated into the cabin.

Figure 11:
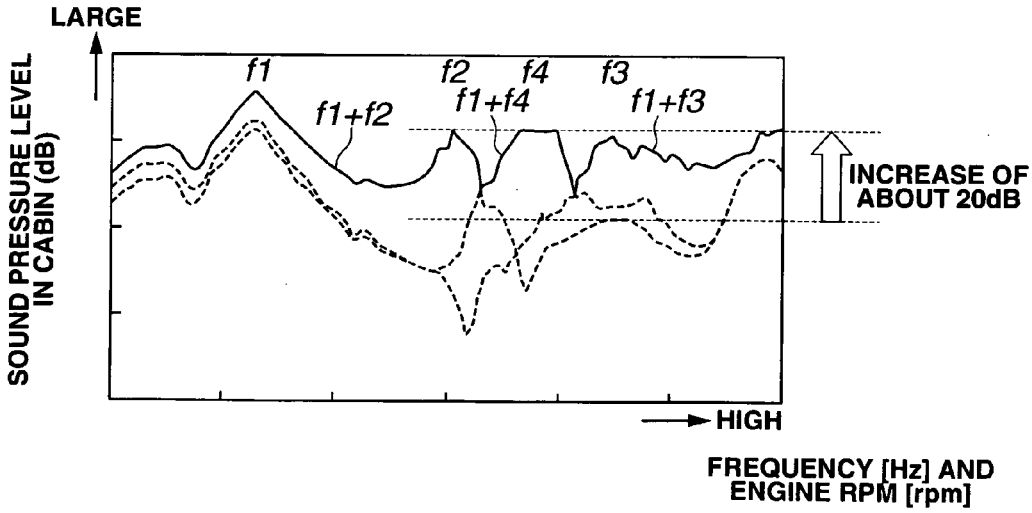
FIG. 11 is a graph showing a relationship between a sound pressure level in the cabin and the engine rpm.

FIG. 11 is a graph showing a relationship between sound pressure level in the cabin and the engine rpm. In the graph, each sound pressure level in the cabin of the above-mentioned three conditions (FIGS. 10A, 10B and 10C) is shown by broken lines (partly, by solid lines over a certain level). "f1+f2" shows the case where the intake sounds are amplified with branch pipe 11 held closed with valve 12 as shown FIG. 10A. "f1+f4" shows the case where the intake sounds are amplified with both branch pipes 10, 11 held open as shown FIG. 10B. "f1+f3" shows the case where the intake sounds are amplified with branch pipe 10 held closed with valve 12 as shown FIG. 10C. As can be seen in the graph, in the case where branch pipe 11 is held closed (namely, the case of "f1+f2"), the sound pressure level is high around the resonance frequencies f1 and f2. However, the sound pressure level falls under the condition where the engine rpm increases and the frequencies of intake sounds become higher. Likewise, as for "f1+f4" and "f1+f3", each sound pressure level is high around respective resonance frequencies f1, f4 and f1, f3. However, both sound pressure levels fall in regions or ranges other than the respective resonance frequencies f1, f4 and f1, f3.

On the other hand, in this embodiment, as can be seen in the graph, by changing the setting of the communicating pipeline, that is to say, by changing the branch pipe communicating with communicating portion 20 from branch pipe 10 to branch pipe 11 by means of valve 12 at a time when the engine rpm reaches an rpm corresponding to the frequency f4, the sound pressure level increases by about 20 dB. Thus, when the frequency of intake sound is high, the communicating pipeline is set to a communicating pipeline whose resonance frequency is high according to the engine rpm, and thereby keep high sound pressure level at any engine rpm as indicated by the solid lines in FIG. 10.

Next, an eighth embodiment will be explained below with reference to a configuration in FIG. 12. The configuration of the eighth embodiment is basically the same as that of the seventh embodiment except for the positioning of the sound increase apparatus 100 in the engine room. As previously described, each top end opening portions 10*a*, 11*a* of branch pipes 10, 11 is opened at different positions in the engine room, so that two sound transfer characteristics (1), (2) from opening position to the cabin are different from each other. Because of this, each sound (intake pulsation) emitted from respective top end opening portions 10*a*, 11*a* is propagated into the cabin under the influence of the different sound transfer characteristics.

Figure 12:
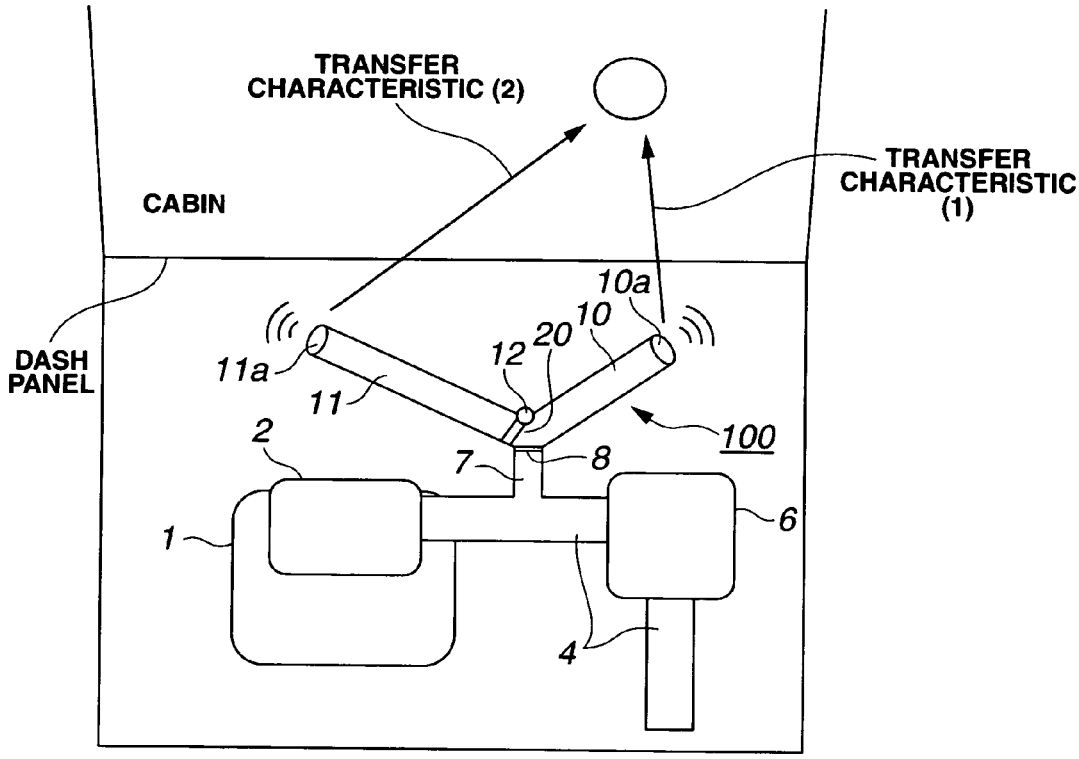
FIG. 12 is a diagram that explains a configuration of a sound increase apparatus according to a eighth embodiment.

As shown in FIG. 12, in the case where the communicating pipeline where branch pipe 10 communicates with communicating portion 20 is formed, as described in the above seventh embodiment, the sounds of the resonance frequencies f1 and f2 are amplified and emitted from top end opening portion 10*a*. At this time, although non-amplified intake sound (namely, intake sound which is not amplified. And its frequency is termed frequency f5) is also emitted from top end opening portion 10*a*, by setting top end opening portion 10*a* to a position where sound transfer characteristic of frequency f5 lowers in the sound transfer characteristics (1), an intake sound pressure level of the frequency f5 becomes lower during the propagation, whereas the intake sound of the resonance frequencies f1 and f2 are conveyed into the cabin with high sound pressure level. In addition, in the case where the communicating pipeline where branch pipe 11 communicates with communicating portion 20 is formed, as described in the above seventh embodiment, the sounds of the resonance frequencies f1 and f3 are amplified and emitted from top end opening portion 11*a*. At this time, although non-amplified intake sound (its frequency is termed frequency f6) is also emitted from top end opening portion 11*a*, by setting top end opening portion 11*a* to a position where sound transfer characteristic of frequency f6 lowers in the sound transfer characteristics (2), an intake sound pressure level of the frequency f6 becomes lower during the propagation, whereas the intake sound of the resonance frequencies f1 and f3 are conveyed into the cabin with high sound pressure level. Consequently, by setting the positions of branch pipes 10, 11 as above, the intake sounds can be conveyed over wide range of frequencies, and a more sporty intake sound can be rendered in the cabin.

Next, a ninth embodiment will be explained below with reference to a configuration in FIG. 13. The configuration of the ninth embodiment is basically the same as that of the seventh embodiment, except that the two branch pipes are changed to a plurality of the branch pipes and these branch pipes can be set as the communicating pipeline.

Figure 13:
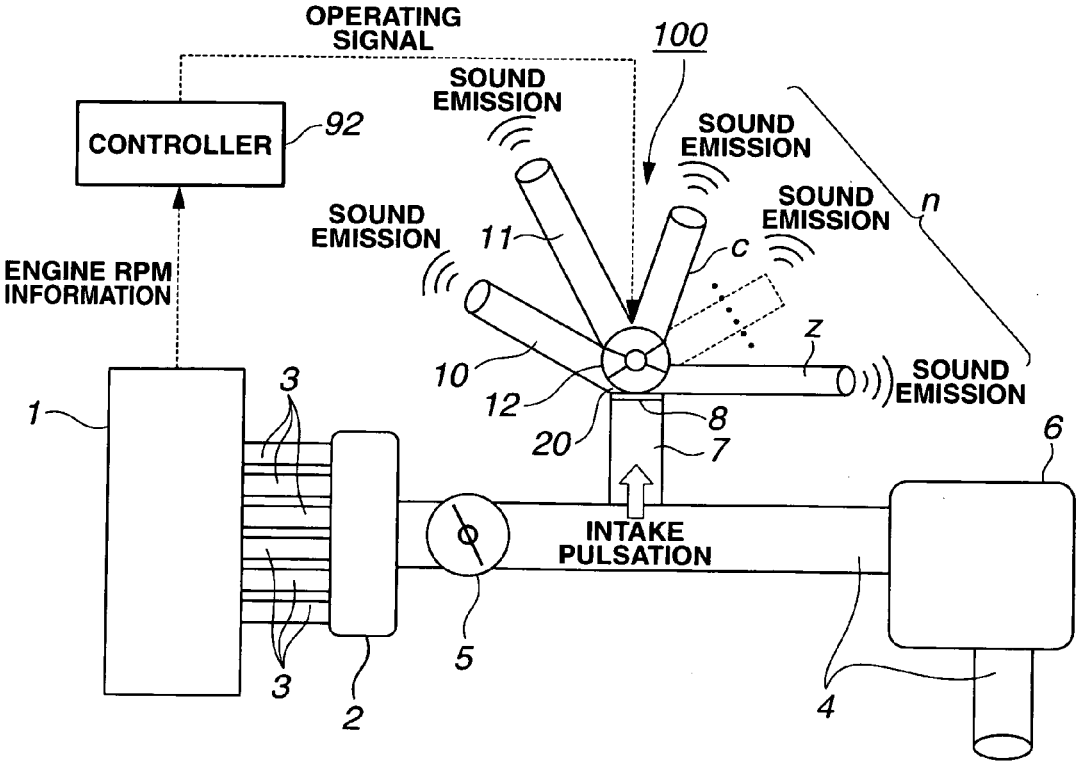
FIG. 13 is a diagram that explains a configuration of a sound increase apparatus according to a ninth embodiment.

In FIG. 13, the plurality of the branch pipes from c to z (the number of branch pipe is "n") are provided besides branch pipes 10, 11. Valve 12 is provided inside communicating portion 20, and is adapted to open/close (or connect/disconnect) each cross section of connection between branch pipe and communicating portion 20. And controller 92 controls valve 12, and therefore each branch pipe can be set (open/close) to form the communicating pipeline. By this control and valve motion, it can be possible to open only one branch pipe or two, three or more branch pipes and to form a variety of communicating pipelines by combination with branch pipes. The intake sounds can be therefore amplified over an extremely wide range of frequencies, and the sounds of a variety of frequencies, which reside in the intake sound, can be amplified.

In the above embodiments, as previously mentioned, with respect to the shape of hollow pipe 7, it may be box-shaped hollow body member. Or hollow pipe 7 may be formed of a plurality of hollow body member. Further, it is not necessary to set the resonance frequency of hollow pipe 7 to be lowest, for instance, it may be the highest. With respect to valve 12, it can be provided not only at cross section of connection between branch pipe and communicating portion 20 but also at some midpoint of the branch pipe. Furthermore, a plurality of the valve could be provided for one branch pipe.

This application is based on a prior Japanese Patent Application No. 2005-295410 filed on Oct. 7, 2005, and a prior Japanese Patent Application No. 2005-377844 filed on Dec. 28, 2005. The entire contents of these Japanese Patent Applications Nos. 2005-295410 and 2005-377844 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A sound increase apparatus comprising:

a first hollow body member that communicates with an intake flow path of an internal combustion engine;

a second hollow body member that communicates with the first hollow body member; and a vibration member inserted and secured in a connection between the first and second hollow body members and vibrating in an out-of-plane direction while constantly closing a cross section of the connection of the first and second hollow body members, wherein the second hollow body member has a plurality of opening portions which directly communicate with outside air.

2. The sound increase apparatus as claimed in claim 1, wherein:

the second hollow body member has a communicating portion connecting to the first hollow body member, and has a plurality of branch pipes that branch off at the communicating portion, and the plurality of branch pipes extend in different directions from each other.

3. The sound increase apparatus as claimed in claim 2, wherein:

the communicating portion is a voluminous hollow portion whose cross-sectional area is larger than that of the first hollow body member and also larger than a sum of cross-sectional areas of the branch pipes.

4. The sound increase apparatus as claimed in claim 2, wherein:

respective lengths of the plurality of branch pipes are different from each other.

5. The sound increase apparatus as claimed in claim 2, wherein:

the first hollow body member is a tubular-shaped member whose length is different from the respective lengths of the plurality of branch pipes.

6. The sound increase apparatus as claimed in claim 2, wherein:

end portions of the plurality of branch pipes, which open to the outside air, are set at different positions from each other.

7. The sound increase apparatus as claimed in claim 2, wherein:

the plurality of branch pipes include only two branch pipes.

8. The sound increase apparatus as claimed in claim 7, wherein:

respective two cross-sectional areas of the two branch pipes are different from each other.

9. The sound increase apparatus as claimed in claim 2, further comprising:

a valve which is capable of opening and closing at least one cross section of a pipe of the plurality of branch pipes and also connects and disconnects a connection between at least one of the pipes of the branch pipes and the communicating portion; and a controller which controls opening and closing of the valve according to engine rpm and sets a communicating pipeline that is formed by connecting the connection between the at least one pipe of the branch pipes and the communicating portion by way of valve control from among pipelines formed by the plurality of branch pipes.

10. The sound increase apparatus as claimed in claim 9, wherein:

the controller controls the valve such that the communicating pipeline has a resonance frequency that is high when the engine rpm increases.

11. The sound increase apparatus as claimed in claim 9, wherein:

respective lengths of the plurality of branch pipes are different from each other.

12. The sound increase apparatus as claimed in claim 9, wherein:

the first hollow body member is a tubular-shaped member whose length is different from the respective lengths of the plurality of branch pipes.

13. The sound increase apparatus as claimed in claim 9, wherein:

end portions of the plurality of branch pipes, which open to the outside air, are set at different positions from each other.

14. The sound increase apparatus as claimed in claim 9, wherein:

the valve is adapted to open and close each cross section of the connections between the respective branch pipes and the communicating portion, and the controller is configured to set both a communicating pipeline where a single branch pipe communicates with the communicating portion and a communicating pipeline where a plurality of pipes of the plurality of branch pipes and the communicating portion are communicated with each other as the communicating pipeline.

15. The sound increase apparatus as claimed in claim 9, wherein:

the plurality of branch pipes include only two branch pipes.

16. The sound increase apparatus as claimed in claim 1, wherein:

the second hollow body member has a communicating portion connecting to the first hollow body member, and has at least one branch pipe that branches off at the communicating portion, and the plurality of opening portions include an opening that is formed at a midpoint in an axial direction of the at least one branch pipe.

17. The sound increase apparatus as claimed in claim 1, wherein:

the second hollow body member has a hollow pipe with an opening end portion that is communicated with the first hollow body member, and has openings that open at another opening end portion of the hollow pipe and at a midpoint in an axial direction of the hollow pipe that serve as the plurality of opening portions.

18. The sound increase apparatus as claimed in claim 1, wherein:

the first and second hollow body members are communicated in series with each other, and the vibration member vibrates with the vibration member closing both cross sections of the first and second hollow body members.

19. The sound increase apparatus as claimed in claim 1, wherein the sound increase apparatus is adapted to increase a sound produced by air flowing through the intake flow path.

20. A sound increase apparatus comprising:

a hollow body member that communicates with an intake flow path of an internal combustion engine and has a plurality of opening portions, each of which directly communicates with the outside air; and a vibration member vibrating in an out-of-plane direction, which is inserted in the hollow body member and constantly closes a cross section of the hollow body member, wherein a sound produced by air flowing through the intake flow path and conveyed via the vibration member is emitted separately from the plurality of opening portions.

21. The sound increase apparatus as claimed in claim 20, wherein:

the hollow body member has a plurality of branch pipes, and the plurality of branch pipes extend in different directions from each other.

22. The sound increase apparatus as claimed in claim 20, wherein:

the hollow body member has a hollow pipe with an opening end portion that is communicated with the intake flow path of the internal combustion engine, and has openings that open at another end portion of the hollow pipe and at some midpoint in an axial direction of the hollow pipe that serve as the plurality of opening portions.

23. The sound increase apparatus as claimed in claim 20, wherein the sound increase apparatus is adapted to increase a sound produced by air flowing through the intake flow path.

* * * * *